US005913300A

United States Patent [19]

Drummond

[11] Patent Number: 5,913,300

[45] Date of Patent: Jun. 22, 1999

[54] INJECTOR

[75] Inventor: Andrew Joseph John Drummond, Ashford, United Kingdom

[73] Assignee: Lucas Industries plc, United Kingdom

[21] Appl. No.: 08/893,799

[22] Filed: Jul. 11, 1997

[30] Foreign Application Priority Data

Jul. 13, 1996 [GB] United Kingdom ..... 9614822

[51] Int. Cl.[6] ..... F02M 37/04

[52] U.S. Cl. ..... 123/467; 123/506

[58] Field of Search ..... 123/467, 506, 123/447, 446

[56] References Cited

U.S. PATENT DOCUMENTS

| | | | |
|---|---|---|---|
| 4,167,168 | 9/1979 | Yamamoto . | |
| 4,440,135 | 4/1984 | Asami . | |
| 4,640,252 | 2/1987 | Nakamura | 123/467 |
| 5,012,786 | 5/1991 | Voss | 123/467 |
| 5,186,151 | 2/1993 | Schwerdt | 123/467 |
| 5,277,163 | 1/1994 | Ohishi | 123/467 |
| 5,522,364 | 6/1996 | Knight | 123/506 |
| 5,605,134 | 2/1997 | Martin | 123/467 |
| 5,626,119 | 5/1997 | Timms | 123/467 |
| 5,638,791 | 6/1997 | Tsuzuki | 123/467 |
| 5,664,545 | 9/1997 | Kato | 123/467 |

FOREIGN PATENT DOCUMENTS

| | | |
|---|---|---|
| 0 675 282 | 10/1995 | European Pat. Off. . |
| 0 726 390 | 8/1996 | European Pat. Off. . |
| 2 336 564 | 7/1977 | France . |
| 2 437 495 | 4/1980 | France . |
| 636098 | 4/1950 | United Kingdom . |
| 1 439 932 | 6/1976 | United Kingdom . |
| 2 030 219 | 9/1978 | United Kingdom . |
| 1 571 413 | 7/1980 | United Kingdom . |

*Primary Examiner*—Carl S. Miller

*Attorney, Agent, or Firm*—Andrus, Sceales, Starke & Sawall

[57] ABSTRACT

An injector is disclosed which comprises a valve needle spring biased into engagement with a seating. The spring engages a spring abutment piston which defines, in part, a chamber which communicates, in use, with a spill valve, a restricted drain passage, and a fuel inlet. A non-return valve is located within the chamber and arranged to control communication between the chamber and the fuel inlet.

7 Claims, 3 Drawing Sheets

FIG 2
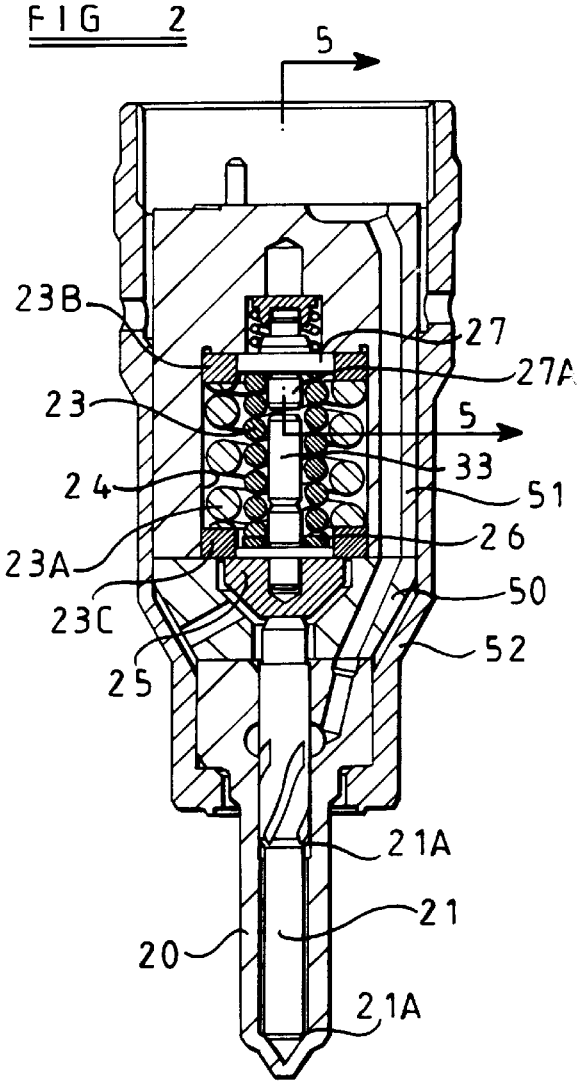
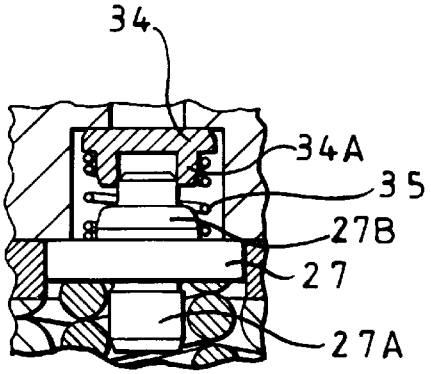
FIG 3
FIG 4
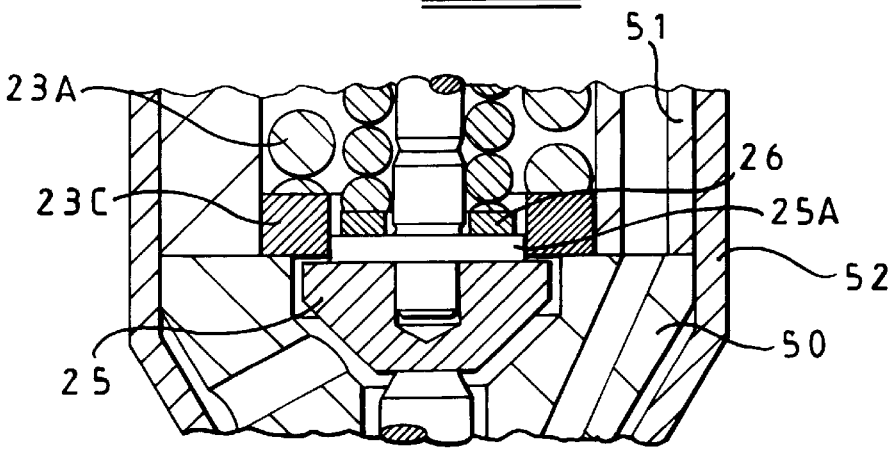

INJECTOR

This invention relates to an injector, and in particular to a fuel injector for use in supplying fuel to a cylinder of an internal combustion engine.

Fuel injectors for use in diesel engines are commonly arranged to open under the application of high pressure fuel thereto. Such an injector comprises a needle which is spring biased into engagement with a seating, the needle being shaped so that on the application of high pressure fuel thereto, the needle lifts from the seating against the action of the spring. When injection is to be terminated, the pressure of fuel applied to the needle is reduced, for example by opening a spill valve which communicates with the fuel supply line supplying fuel from a pump to the needle.

In order to increase the rate of closure of the injector, it is known to apply fuel from the spill valve, at high pressure, to a face of the needle to assist the spring in returning the needle into engagement with the seating. It is further known to arrange the spring so as to be engaged between the needle and a spring abutment piston which, during injection, acts as a lift stop for the valve needle, fuel from the spill valve being applied to the piston on termination of injection to assist movement of the needle into engagement with its seating.

Where a spill valve is provided, it is known to supply fuel to the fuel pump through the spill valve, a non-return valve being provided between the fuel source and the spill valve in order to ensure that high pressure fuel from the spill valve is supplied to the injector to assist movement of the needle into engagement with its seating rather than being returned directly to a fuel reservoir.

It is an object of the invention to provide an injector suitable for use in the circumstances described hereinbefore.

According to a first aspect of the invention there is provided an injector comprising a needle slidable within a housing and biased into engagement with a seating by a spring, the spring engaging a first end of a spring abutment piston, a second end of the spring abutment piston defining, with the housing, a chamber housing a non-return valve arranged to control the supply of fuel to the chamber from an inlet to prevent fuel from flowing from the chamber to the inlet, the chamber further communicating with a passage arranged, in use, to communicate with a spill valve.

In use, during filling of an associated fuel pump the spill valve is open, and fuel is supplied to the inlet, through the non-return valve to the chamber, and from the chamber to the spill valve and the pump. Subsequently, the spill valve is closed and the pump supplies fuel at high pressure to the injector. The injector opens, whereby fuel is supplied to the associated cylinder of the engine. In order to terminate injection, the spill valve is opened. High pressure fuel is then supplied through the spill valve to the chamber to assist movement of the needle into engagement with its seating. The presence of the non-return valve substantially prevents the fuel flowing to the inlet.

The invention further relates to a fuel system comprising a fuel pump, a spill valve, and an injector in accordance with the first aspect of the invention, wherein during filling of the pump, fuel is supplied through the non-return valve and chamber of the injector and through the spill valve to the pump, and after injection fuel from the pump is supplied through the spill valve to the chamber of the injector.

The invention will further be described, by way of example, with reference to the accompanying drawings, in which:

FIG. 2 is a cross-sectional view of an injector in accordance with an embodiment of the invention;

FIG. 3 is an enlarged view of part of FIG. 2;

FIG. 4 is a further enlarged view of part of FIG. 2;

Figure 1:
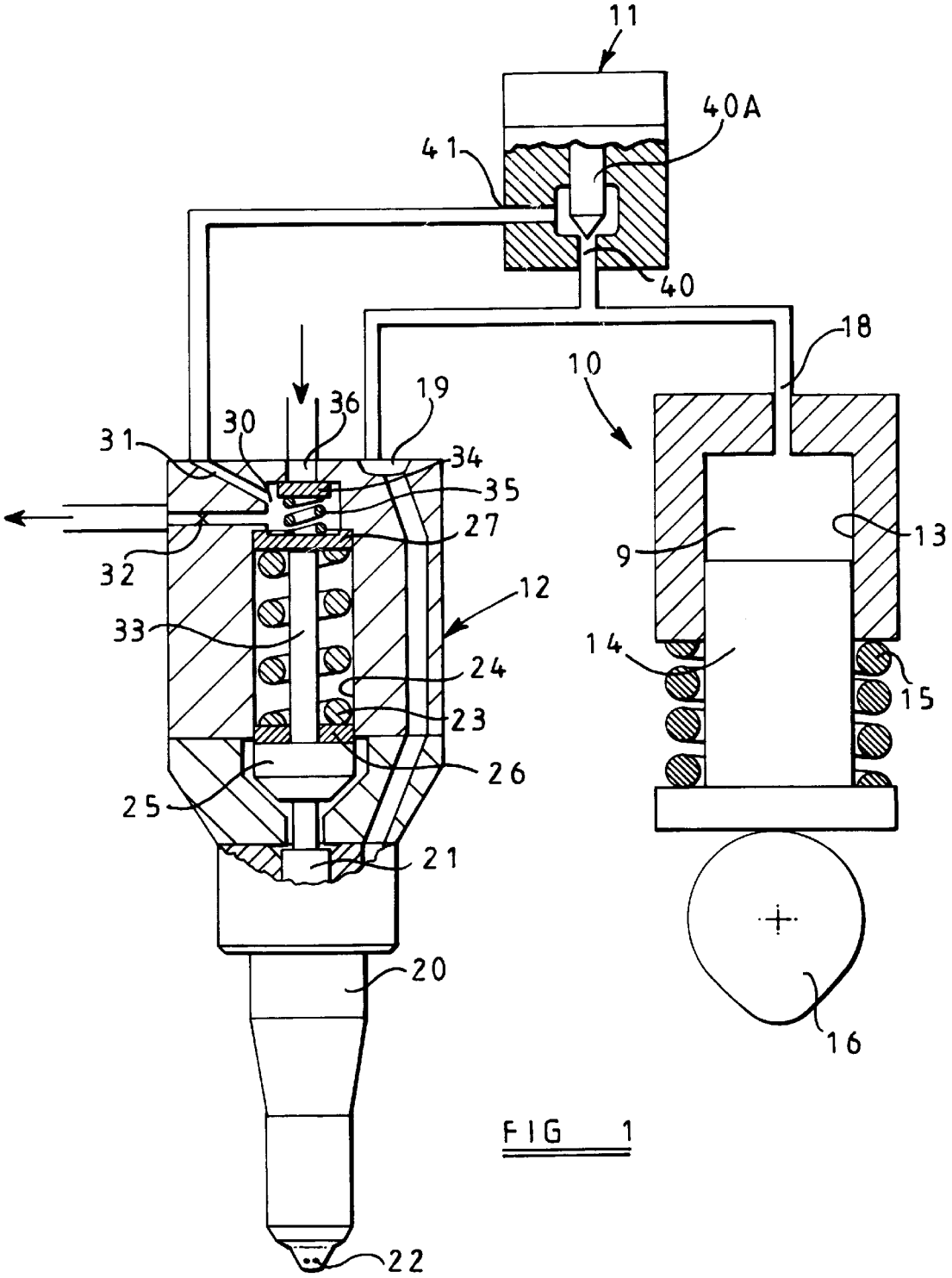
FIG. 1 is a diagrammatic view of a fuel system.

FIG. 1 illustrates a fuel system which comprises a pump 10 including a housing within which a bore 13 is provided, a plunger 14 being reciprocable within the bore 13. The plunger 14 is reciprocable under the action of a cam 16, a spring 15 being provided to bias the plunger 14 into engagement with the cam 16. The plunger 14 and bore 13 together define a pumping chamber 9 which communicates through an outlet passage 18 with the high pressure inlet 19 of an injector 12.

A spill valve 11 communicates with the passage 18, the spill valve 11 comprising a valve member 40A which is engageable with a seating to control communication between a line 40 which communicates with the passage 18 and a line 41 which communicates with a passage 31 of the injector 12 (described below).

The injector 12 comprises a valve needle 21 which is slidable within a bore provided in a nozzle 20, an end of the valve needle 21 being engageable with a seating in order to control the supply of fuel from the high pressure inlet 19 to outlet apertures 22 provided in the nozzle 20.

The valve needle 21 carries a spring abutment member 25 and shim 26 which engage a coiled compression spring 23, the spring 23 being located within a bore provided in the injector 12 which defines a spring chamber 24. A second end of the spring 23 engages a spring abutment piston 27 which is slidable in the bore defining the spring chamber 24, the face of the piston 27 remote from the spring 23 defining, with part of the bore, a chamber 30 which communicates through a passage 31 with the line 41 connected to the spill valve 11. The chamber 30 further communicates through a restricted drain passage 32 with a suitable low pressure drain.

The chamber 30 houses an inlet one-way valve which comprises a valve member 34 biased by means of a spring 35 into engagement with a seating provided around an inlet passage 36. The inlet valve permits fuel to flow from the inlet passage 36 to the chamber 30, but is arranged to substantially prevent fuel flowing from the chamber 30 to the inlet passage 36.

In use, in the position illustrated in FIG. 1, the plunger 14 is located in its outer position, the pumping chamber 9 being charged with fuel at relatively low pressure. Rotation of the cam 16 results in fuel being displaced through the spill valve 11 and chamber 30 to the low pressure drain. Subsequently, the spill valve 11 is actuated so as to move the valve member 40A thereof into engagement with its seating and break communication between the lines 40 and 41. Further rotation of the cam 16 results in the plunger 14 continuing to be pushed inwards, thus increasing the pressure of the fuel within the pumping chamber 9 and outlet passage 18, thus high pressure fuel is supplied to the high pressure fuel inlet 19 and to the valve needle 21. The application of high pressure fuel to the valve needle 21 acts against the action of the spring 23 and when the pressure becomes sufficiently high, the valve needle 21 is lifted from its seating thereby permitting fuel to flow to the outlet apertures 22, movement of the needle 21 being limited by a stop 33 carried thereby engaging the spring abutment piston 27.

When injection is to be terminated, the spill valve 11 is actuated to lift the valve member 40A thereof away from its seating, thus permitting fuel at high pressure to flow through the line 40 to the line 41 and from there through the passage 31 to the chamber 30. The pressure in the pump chamber 9 and that applied to the needle 21 is thereby reduced thus the needle 21 moves towards the seating under the action of the spring 23.

The presence of the inlet valve substantially prevents the high pressure fuel from the chamber 30 escaping through the inlet passage 36, the restricted drain passage 32 permitting flow of fuel from the chamber 30 at a low rate, thus maintaining the pressure in the chamber 30 at a relatively high level. The high pressure within the chamber 30 acts against the spring abutment piston 27, moving the piston 27 to assist movement of the needle 21 into engagement with its seating due to the engagement between the piston 27 and the stop 33 and due to the engagement of the spring 23 with the piston 27.

Continued rotation of the cam 16 causes further fuel to be expelled from the pumping chamber 9 through the spill valve 11 to the chamber 30. The presence of the restricted drain passage 32 permits the pressure within the chamber 30 to fall at a relatively low rate thus permitting the piston 27 to return to the position shown in FIG. 1 under the action of the spring 23.

In order to ensure that the inlet valve remains closed during termination of delivery, the spring 35 is prestressed thus the spring provides a force acting to maintain the valve member 34 in engagement with its seating throughout the range of movement of the spring abutment piston 27. It will be appreciated that whilst the pressure in the chamber 30 is high, such high pressure will assist the spring in maintaining the valve member 34 in engagement with its seating.

Further rotation of the cam 16 results in the plunger 14 being retracted from the bore 13 under the action of the spring 15. The retraction of the plunger 14 reduces the fuel pressure in the chamber 30 to a sufficient extent that the fuel pressure in the inlet passage 36 is able to lift the valve member 34 of the non-return valve away from its seating against the action of the spring 35, and hence permit fuel to flow to the chamber 30 and subsequently through the passage 31 through the spill valve 11 to the pumping chamber 9. When filling of the pumping chamber 9 is completed, the pressure of fuel within the chamber 30 will be sufficient to assist the spring 35 in returning the valve member 34 into engagement with its seating, and hence terminating the flow of fuel through the inlet passage 36 to the chamber 30. The presence of the restriction in the restricted drain passage 32 restricts the flow of fuel from the low pressure drain to the chamber 30 during filling. The pump is then returned to the position illustrated in FIG. 1, ready for another pumping cycle to commence.

FIGS. 2 to 5 illustrate a practical embodiment of an injector similar to that illustrated diagrammatically in FIG. 1, and like reference numerals are used to denote like parts.

The injector illustrated in FIG. 2 comprises a nozzle 20 within which a needle 21 is slidable, the needle 21 including angled surfaces 21A against which high pressure fuel can act in order to lift the needle 21 from its seating as described hereinbefore. The nozzle 20 engages a distance piece 50 which in turn engages a holder 51, a cap nut 52 being used to secure the assembly of the nozzle 20, distance piece 50 and holder 51 to the remainder of the injector.

The holder 51 is provided with a bore defining a spring chamber 24 within which spring 23 is located. As in the arrangement illustrated in FIG. 1, the spring 23 is engaged between a spring abutment 25 and shim 26 carried by the needle 21 and a spring abutment piston 27. In addition, an additional spring 23A is provided, the spring 23A engaging a shim 23B which, in turn, engages the holder 51, the shim 23B surrounding the piston 27. The other end of the spring 23A engages a shim 23C which in the position illustrated in FIGS. 2 and 4 engages the distance piece 50, the shim 23C being spaced from the spring abutment 25 in this position. In use, it will be recognised that the initial movement of the needle 21 acts against the action of the spring 23, and after a predetermined movement of the needle 21, the spring abutment 25 engages the shim 23C, subsequent movement of the needle acting against both the spring 23 and the additional spring 23A. Two stage lifting movement of the valve needle 21 is therefore achieved.

In order to provide a flow path between the piston 27 and shim 23B, the opening provided in the shim 23B in which the piston 27 is slidable is conveniently of non-circular form, the flats defined by the opening guiding movement of the piston 27. The spring chamber 24 is conveniently connected to a suitable drain.

Movement of the shim 23C is guided by the fit between the shim 23C and the spring chamber 24. The spring abutment 25 carries a peg 25A which is guided by its fit within the shim 23C, the peg 25A carrying the shim 26 and guiding movement of the spring abutment 25.

As described hereinbefore, lifting movement of the needle 21 is limited by engagement of a stop 33 carried thereby with the piston 27, and in particular with an extension 27A of the piston 27. The extension 27A further acts as a locator for locating the end of the spring 23. The face of the spring abutment piston 27 facing away from the spring 23 is provided with a projection 27B which acts as a guide for the spring 35 of the one-way valve. The valve element 34 of the one-way valve is further provided with an extension 34A which also acts as a guide for the spring 35, the extension 34A of the valve element 34 including a recess within which an end of the projection 27B is received in order to correctly locate the valve element 34 within the chamber 30. The end of the projection 27B and the part of the extension 34A defining the recess are conveniently of frusto-conical form in order to assist such location.

Figure 5:
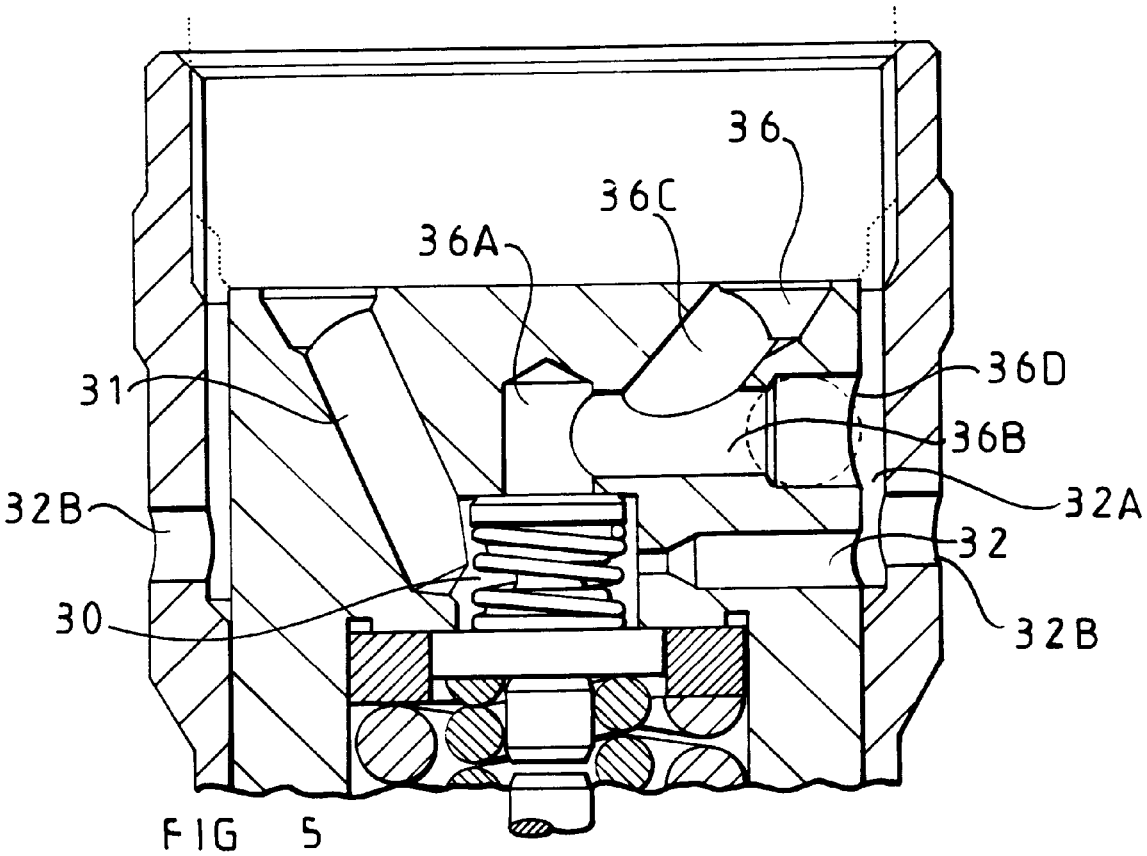
FIG. 5 is an enlarged sectional view along the line 5—5 of FIG. 2.

FIG. 5 is an enlarged sectional view illustrating the connections to the chamber 30, illustrating that in a convenient arrangement, the inlet passage 36 comprises an axial passage 36A, a passage 36B extending radially from the passage 36A and an angled passage 36C communicating with the radially extending passage 36B. The radially extending passage 36B opens into an annular chamber 32A which communicates with the restricted drain passage 32, the annular chamber 32A being provided between the holder 51 and the cap nut 52. Passages 32B are provided to permit communication between the annular chamber 32A and a suitable low pressure drain. In order to prevent direct communication between the inlet passage 36 and the low pressure drain, a suitable plug is provided in the radially outer end of the radially extending passage 32B, and in FIG. 5, the plug is denoted by the dotted lines 36D.

Figure 6:
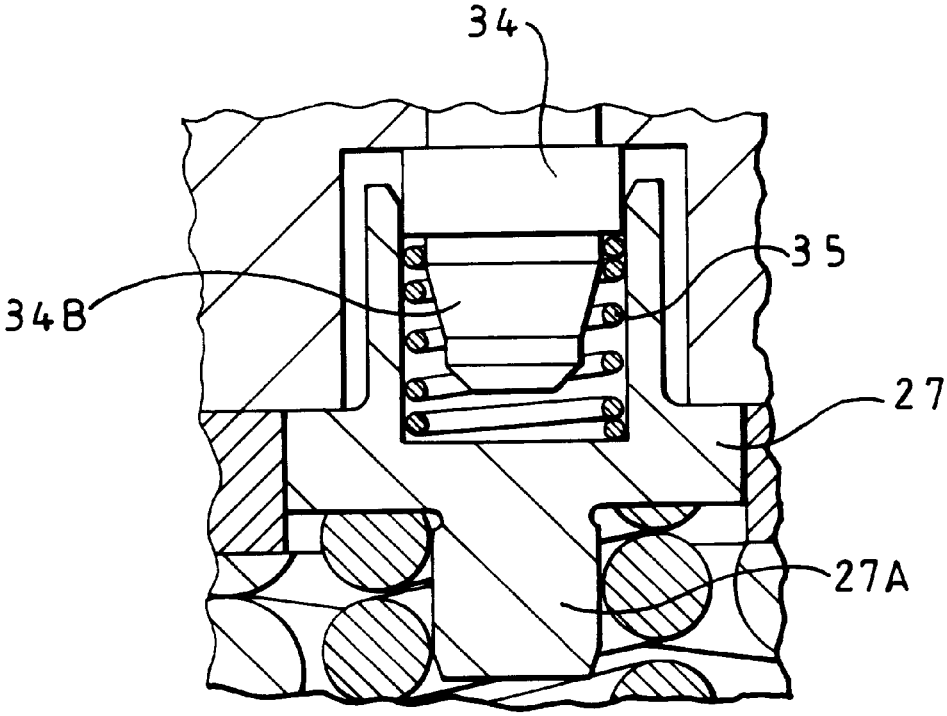
FIG. 6 is a view similar to FIG. 3 of an alternative embodiment.

FIG. 6 is a view similar to FIG. 3 illustrating an alternative inlet valve. In the arrangement of FIG. 6, the valve element 34 includes an integral downwardly extending projection 34B which acts as a guide for the spring 35. The piston 27 includes an upwardly extending annular wall or projection 27C which acts as a shroud protecting the spring 25 from the pressure pulse which occurs, in use, on opening the spill valve and also guiding movement of the valve element 34.

The possible movement of the valve member 34 is limited by the end of the projection 34B engaging the piston 27. As the movement of the valve member 34 is limited, the maximum flow rate through the inlet valve is restricted.

At the end of injection, the fuel pressure within the chamber 30 increases as described hereinbefore, moving the piston 27 downwardly to assist closure of the valve needle. Subsequent return of the piston 27 is damped by the flow of fuel between the valve element 34 and projection 27C being restricted. Such damping reduces damage to the piston 27 hence increasing the useful life of the injector.

Although the description hereinbefore is of the provision of a non-return valve including a substantially plate-like valve, the valve could be replaced by a suitable ball valve. It is thought, however, that the provision of a ball valve would result in inconsistent wear and hence inconsistent leakage, the provision of a plate valve increasing the reliability and the length of useful life of the injector.

I claim:

1. A fuel system comprising a fuel pump, a spill valve, and an injector, the injector comprising a valve needle slidable within a housing and biased into engagement with a seating by a spring, the spring engaging a first end of a spring abutment piston, the spring abutment piston having a second end which defines, with the housing, a chamber housing a non-return valve arranged to control communication between the chamber and an inlet, the chamber communicating with the spill valve, wherein during filling of the pump, fuel is supplied to the chamber through the non-return valve and from the chamber to the pump through the spill valve, and after injection fuel is supplied through the spill valve to the chamber, the non-return valve substantially preventing such fuel from flowing to the inlet, wherein the non-return valve comprises a valve member biased into engagement with an associated seating by a spring, the spring engaging the spring abutment piston.

2. An injector comprising a needle slidable within a housing and biased into engagement with a seating by a spring, the spring engaging a first end of a spring abutment piston, a second end of the spring abutment piston defining, with the housing, a chamber housing a non-return valve arranged to control the supply of fuel to the chamber from an inlet to substantially prevent fuel from flowing from the chamber to the inlet, the chamber further communicating with a passage arranged, in use, to communicate with a spill valve, wherein the non-return valve comprises a valve member biased into engagement with an associated seating by a spring the spring engaging the spring abutment piston.

3. An injector as claimed in claim 2, further comprising guide means for said valve member.

4. An injector as claimed in claim 3, wherein the guide means comprises a projection associated with the spring abutment piston, the projection being received within a recess provided in the valve member to guide movement of the valve member relative to the spring abutment piston.

5. An injector as claimed in claim 3, wherein the guide means comprises a recess provided in the spring abutment piston within which part of the valve member is slidable.

6. An injector as claimed in claim 2, wherein the non-return valve comprises a plate valve.

7. An injector as claimed in claim 2, wherein the non-return valve comprises a ball valve.

* * * * *